US005499514A

United States Patent [19]

Ho

[11] Patent Number: 5,499,514

[45] Date of Patent: Mar. 19, 1996

[54] DEFROST WATER DRAIN SYSTEM FOR A REFRIGERATOR

[75] Inventor: Robert K. Ho, Evansville, Ind.

[73] Assignee: Whirlpool Corporation, Benton Harbor, Mich.

[21] Appl. No.: 306,298

[22] Filed: Sep. 15, 1994

[51] Int. Cl.[6] ..... F25D 21/14

[52] U.S. Cl. ..... 62/291; 62/410

[58] Field of Search ..... 62/410, 285, 288, 62/291

[56] References Cited

U.S. PATENT DOCUMENTS

| | | | |
|---|---|---|---|
| 2,617,268 | 11/1952 | Ashby et al. | 62/103 |
| 2,688,235 | 9/1954 | Schwenker | 62/103 |
| 2,696,716 | 12/1954 | Marks | 62/103 |
| 2,954,683 | 10/1960 | Ohlsson | 62/277 |
| 3,020,733 | 2/1962 | Hubacker et al. | 62/291 X |
| 3,696,632 | 10/1972 | Carlin et al. | 62/410 X |
| 4,662,270 | 5/1987 | Fiddler et al. | 62/410 X |
| 4,843,835 | 7/1989 | Goetz et al. | 62/285 |

*Primary Examiner*—William E. Tapolcai

*Attorney, Agent, or Firm*—Thomas J. Roth; Joel M. Van Winkle

[57] ABSTRACT

A refrigerator having a defrostable evaporator disposed in a food storage compartment wherein a drain system is provided for disposing of the defrost water dripping from the evaporator during a defrost operation. The drain system includes a drip tray disposed within the food storage compartment below the evaporator and an evaporator pan mounted below the food storage compartment. A drain tube is provided having a first end positioned below the drip tray for receiving the defrost water and having a second end positioned over the evaporator pan such that the drain tube drains the defrost water from the drip tray into the evaporator pan. The drain tube further includes a drain trap portion and a vent disposed upstream of the drain trap portion. The vent includes a valve for allowing air flow into the drain tube for equalizing the air pressure in the food storage compartment with the ambient air pressure but prevents air flow out of the drain tube such that no thermal leakage occurs through the drain tube.

9 Claims, 2 Drawing Sheets

DEFROST WATER DRAIN SYSTEM FOR A REFRIGERATOR

BACKGROUND OF THE INVENTION

This invention relates generally to refrigeration defrost systems and more particularly to a defrost water drain system for use in a refrigerator.

As is known, refrigerator and freezer systems, especially of the home appliance type, provide cooled air to an enclosure in which food and the like can be stored, thereby to prolong the edible life of the food. The enclosures, namely fresh food compartments and freezer compartments, are cooled by air blown over a heat exchanger or evaporator. The heat exchanger, typically located in an evaporator enclosure in the freezer compartment, extracts heat from the air thereby producing cooled air. The heat exchanger generally operates on the known cooling effect provided by gas that is expanded in a closed circuit, i.e., the refrigeration cycle. However, to be expanded, the gas must also be compressed and this is accomplished by the use of a compressor. During operation of the compressor, an evaporator fan moves air across the evaporator for assisting in heat transfer.

The efficiency of such systems can be enhanced by reducing the amount of frost that builds up on the heat exchanger, as is known. Modern systems are generally of the self-defrosting type. To this end, they employ a heater specially positioned and controlled to slightly heat the heat exchanger to cause melting of frost build-up on the heat exchanger. These defrost heaters are controlled pursuant to defrost cycle algorithms and configurations.

As the defrost heater warms the evaporator, defrost water resultant from the melting of frost build-up, drips from the evaporator and is typically collected into a drip tray disposed below the evaporator. Drain tubing is connected to the drip tray and directly drains the defrost water to an evaporator pan which is generally located below the freezer compartment in a compressor compartment adjacent a condenser and condenser fan for promoting evaporation of the defrost water delivered to the evaporator pan.

Such a system, however, has disadvantages. Specifically, the conventional defrost water drain tubing has a detrimental effect on the efficiency of the refrigerator. During compressor operation, the evaporator fan draws air across the evaporator and creates a lower partial pressure in the evaporator enclosure wherein hot, moist air from the compressor compartment is drawn into the evaporator compartment through the drain tubing. Additionally, when the compressor and evaporator fan are not operating, the cold air within the food compartment, being relatively more dense than the external ambient air, flows through the drain tubing out of the evaporator enclosure and into the ambient environment during normal compressor operation. This flowing of cold air out of the evaporator compartment results in warm air migrating into the food storage compartments. Therefore, both when the compressor and evaporator fan are operating and when they are not operating, undesirable transfer of air may occur through the defrost water drain tubing resulting in a thermal leak. It can be understood by one skilled in the art, that these types of thermal leaks are detrimental to the overall efficiency of a refrigerator.

SUMMARY OF THE INVENTION

It is desirable, therefore, to prevent the above described thermal leakage through the defrost water drain tubing. This may be accomplished through the incorporation of a drain trap into the defrost water drain tubing. In this fashion, a column of water is disposed in the drain tubing, thereby preventing air flow through the drain tubing. The applicants have discovered, however, that the use of a trap in the defrost water drain tubing has drawbacks.

As can be understood by one skilled in the art, when a door to a refrigerator compartment is opened, warm air is drawn into the compartment replacing the cold air of the compartment. When the door closes, however, the refrigerator operates to cool the air disposed in the compartment causing the air pressure in the refrigerator compartments to drop relative to the external ambient air pressure. In a modern, highly efficient refrigerator, the food storage compartments form a relatively air tight enclosure when the respective compartment doors are closed, wherein the only air vent with the ambient environment in the typical refrigerator is a conventional defrost water drain system, as described above.

In the typical refrigerator, therefore, the air pressure in the food compartment is allowed to equalize with the ambient air pressure by way of air flow through the drain tube. However, as described above, the present invention provides for a drain trap in the defrost water drain tubing wherein air flow for equalizing the air pressure in the food compartment with the ambient pressure is blocked. In a refrigerator having a defrost water drain system including a drain trap, as a vacuum forms in the food storage compartment the column of water disposed in the drain trap moves up toward the food storage compartment, against the urging of gravity, under the force of the ambient air pressure. The column of water rises to a level at which ambient air passes through the drain trap, resulting in undesirable gurgling or bubbling noises as the air pressure in the food storage compartment is equalized. In this fashion, such undesirable gurgling noises occur until the pressure head of the water column from the drain trap exceeds the differential between the food storage compartment air pressure and the ambient air pressure. Further, the final pressure in the food storage compartment, dependent on the pressure head of the drain trap, is less than the ambient pressure thereby contributing to undesirably high door opening forces, as can be understood by one of skill in the art.

One object of the present invention, therefore, is to prevent thermal leakage through a defrost water drain system in a refrigerator.

Another object of the present invention is to prevent thermal leakage through a defrost water drain system in a refrigerator and to provide an air vent for equalizing the pressure within the food storage compartments of the refrigerator with the ambient pressure.

A further object is to provide a defrost water drain tube for draining defrost water from an evaporator in a refrigerator wherein the drain tube includes a drain trap and an air vent having a valve for equalizing the pressure in the food storage compartments of the refrigerator with the ambient pressure.

According to the present invention, the foregoing and other objects are attained by a refrigerator having a defrostable evaporator disposed in a food storage compartment wherein a drain system is provided for disposing of the defrost water dripping from the evaporator during a defrost operation. The drain system includes a drip tray disposed within the food storage compartment below the evaporator and an evaporator pan mounted below the food storage compartment. A drain tube is provided having a first end positioned below the drip tray for receiving the defrost water and having a second end positioned over the evaporator pan such that the drain tube drains the defrost water from the drip tray into the evaporator pan. The drain tube includes a drain trap portion and a vent disposed upstream of the drain trap portion. The vent includes a valve for allowing air flow into the drain tube for equalizing the air pressure in the food storage compartment with the ambient air pressure but prevents air flow out of the drain tube such that thermal leakage is effectively eliminated.

DESCRIPTION OF THE PREFERRED EMBODIMENT

Figure 1:
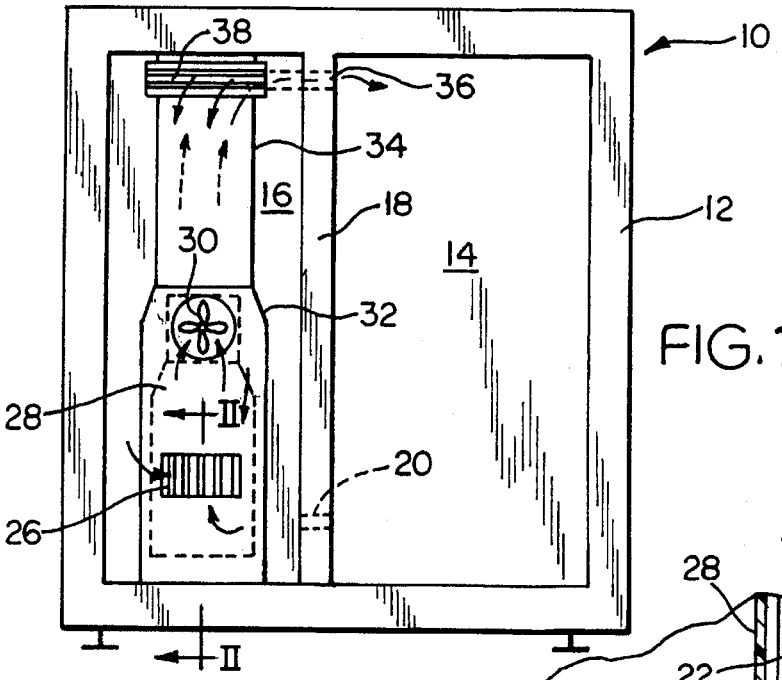
FIG. 1 is a front elevational view of a side-by-side refrigerator unit having a defrost drain system embodying the present invention, the doors of the unit being removed to facilitate illustration of the invention.

In the exemplary embodiment of the invention as disclosed in the drawings, a refrigerator 10 is shown to comprise an upright side-by-side configuration. A cabinet 12 defines an above-freezing refrigeration space or fresh food compartment 14 and a below-freezing space or freezer compartment 16. The compartments 14 and 16 are separated by a wall 18 having a through air passage 20 in a lower portion thereof for conducting air from the fresh food compartment to an evaporator enclosure 22 (FIG. 2) in which a fin and tube type evaporator 24 (FIG. 2) is disposed. Air from the freezer compartment 16 is introduced into the evaporator enclosure 22 through grill openings 26 provided in an evaporator cover wall 28.

Air is circulated in heat transfer association with the evaporator 24 through the evaporator enclosure 22 by a suitable air moving means herein illustratively comprising a fan 30 disposed within a suitable shroud 32 leading upwardly from the top of the evaporator enclosure 22 to a discharge duct 34 having a discharge opening 36 leading to the fresh food compartment 14 and a discharge opening 38 leading to the freezer compartment 16.

Figure 2:
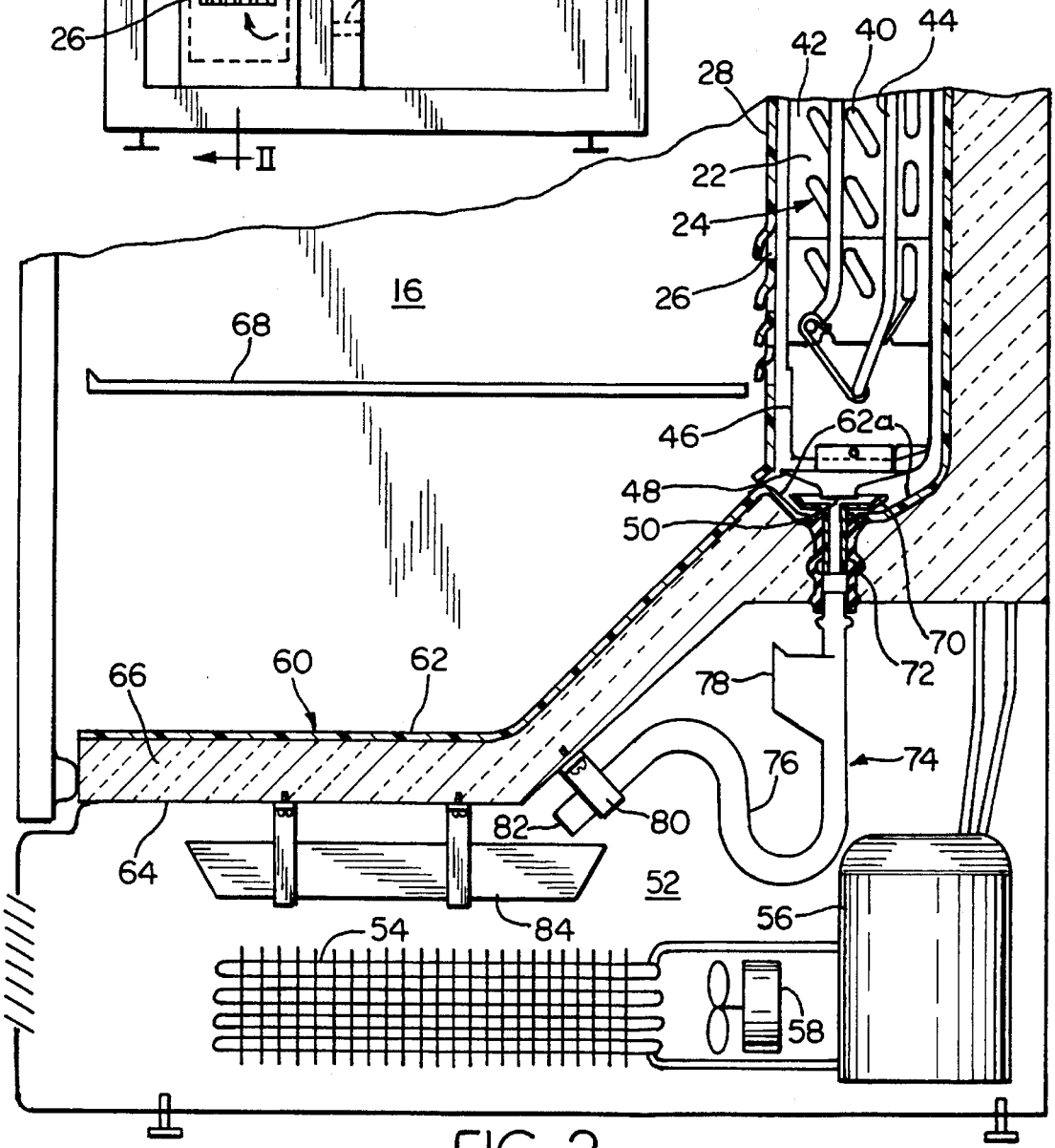
FIG. 2 is a side sectional view of the lower portion of the refrigerator taken along line II—II of FIG. 1

As shown in FIG. 2, the evaporator 24 comprises a tube portion 40 for conducting refrigerant fluid therethrough and a plurality of fins 42 in thermal transfer association with the tube portion 40 for heat transfer with the air flowing upwardly past the evaporator urged by the fan 30. The evaporator 24 is further provided with a defrost heater 44 for periodically defrosting the evaporator 24.

A shield member 46, preferably metallic, is provided partially surrounding the back and side surfaces of the evaporator 24. A drip pan portion 48, disposed below the evaporator, collects defrost water which drips from the evaporator 24 during a defrost cycle. The drip pan portion 48 is configured to direct the collected defrost water toward an opening 50, provided in the lowest portion of the drip pan 48.

In the preferred embodiment, the freezer and fresh food compartments 14 and 16 are disposed above a compressor compartment 52. Disposed within the compressor compartment 52 is a condenser 54 and a compressor 56 fluidly interconnected with the evaporator and condenser for moving refrigerant fluid therethrough, as is known. A fan 58 is provided for moving air over the condenser for promoting heat exchange between the condenser and the ambient air. Separating the compressor compartment 52 from the freezer compartment 16 is a bottom partition wall 60 comprising an inner liner 62 and a bottom panel 64 and having foamed insulation 66 disposed therebetween. As is known, the inner liner 62 defines the freezer compartment and supports shelves 68 and the like.

As described above, the evaporator 24 is disposed along the back wall of the freezer compartment 16, adjacent the inner liner 62, behind the evaporator cover wall 28. The drip pan opening 50 is disposed above a drain ferrule 70 which is inserted into a grommet 72 which is disposed between the inner liner 62 and the bottom panel 64 for providing a channel between the freezer compartment 16 and the compressor compartment 52. It can be understood, therefore, that defrost water is directed by the drip pan portion 48 to flow through the grommet 72. The inner liner 62 may also be configured to channel the defrost water toward the drain ferrule 70 and grommet 72 by providing drain slope portions 62*a*.

A drain tube 74 is inserted into the lower portion of the grommet 72 for receiving defrost water dripping from the evaporator 24. The drain tube 74 includes a drain trap portion 76 and a vent 78 having a one way valve. The drain tube may be supported by a bracket 80 extending from the bottom panel 64 and has a discharge end 82 disposed above an evaporator pan 84. In this fashion, the evaporator pan 84 receives the defrost water and provides an ideal location for the subsequent disposal of the defrost water through evaporation.

As described above, the drain trap portion 76 prevents air flow from the evaporator enclosure 22 to the compressor compartment 52 through the drain tube 74, thereby preventing thermal leakage. The drain vent 78, however, allows for pressure equalization between the freezer compartment and the ambient pressure while at the same time effectively eliminating thermal leakage.

Figure 3:
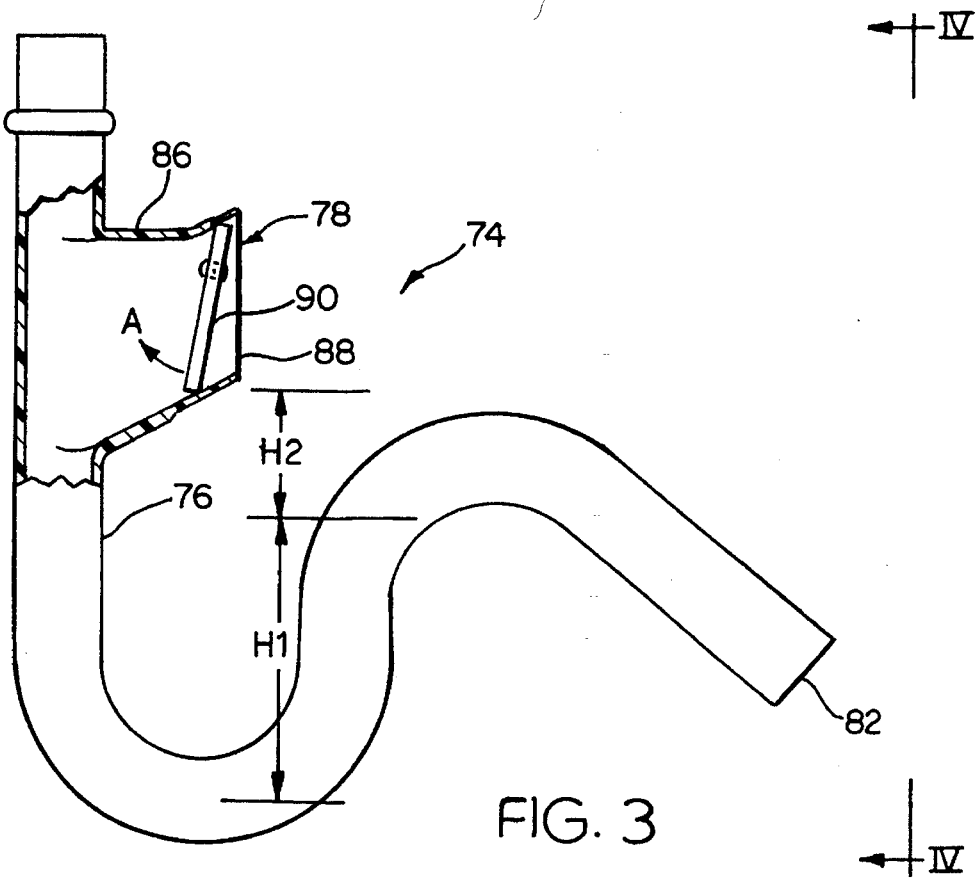
FIG. 3 is a partially cut away elevational view of the drain tube of the defrost drain system of the present invention.
Figure 4:
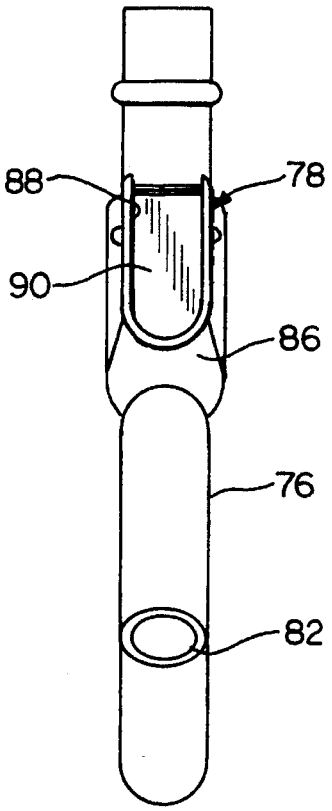
FIG. 4 is a side view of the drain tube of the defrost drain system taken along line IV—IV of FIG. 3.

As shown in FIGS. 3 and 4, the drain vent 78 includes a vent extension portion 86 having an opening 88 and a flapper 90 pivotally mounted within the vent extension portion 86. The vent is configured such that the flapper 90, under the urgings of gravity, is normally closed, completely blocking the opening 88 of the vent extension portion 86. In the normally closed position, the side edges of the flapper 90 are adjacent the side walls of the vent extension portion and the top and bottom edges of the flapper are adjacent the top and bottom walls of vent extension portion 86, respectively. When a vacuum forms in the refrigerator compartments 14 and 16, the flapper 90 freely rotates clockwise, as indicated by arrow A, thereby allowing air flow through the opening 88 into the drain tube 74. However, air flow out of the drain tube 74, which urges the flapper 90 to rotate counterclockwise is prevented due to the engagement of the top and bottom edges of the flapper 90 with the top and bottom walls of the extension portion 86. In this fashion, the flapper 90 operates as a one way valve or check valve for allowing air flow through the drain tube 74 into the evaporator enclosure 22 to equalize the pressure in the compartments 14 and 16 with the ambient pressure while preventing air flow out of the evaporator enclosure 22 through the drain tube 74.

It can be understood by one skilled in the art that the drain tube 74 is configured such that the drain trap 76 has a height H1 and a distance H2 from the drain trap to the vent opening 88 great enough for forming a pressure head which exceeds the pressure differential between the compartments 14 and 16 and the ambient environment which is required for rotating the flapper 90 for opening the vent 78.

Although the present invention has been described with reference to a specific embodiment, those of skill in the Art will recognize that changes may be made thereto without departing from the scope and spirit of the invention as set forth in the appended claims. For example, it can be understood by one skilled in the art that the drip pan 48 may be omitted and the defrost water may drip directly onto the liner 62 wherein the defrost water is directed toward the drain tube 74. It can be further understood that in some types of refrigerators, particularly those have the freezer compartment located above the fresh food compartment, the drain tube 74 may comprise several members and may extend from the bottom of the freezer compartment the entire height of the fresh food compartment to the compressor compartment and a drain trap may be located at any position in the drain tubing. Additionally, it may be understood by one skilled in the art, to provide a drain trap in the drain tube and provide an air vent for equalizing the pressure in the food compartments which is not incorporated into the drain tubing. Still further, different types of check valves may be utilized, for example a check ball type valve or duck-bill valve may be utilized.

It should be understood, therefore, that I wish to embody within the scope of the patent warranted hereon all such modifications as reasonably and properly come within the scope of my contribution to the art.

I claim:

1. A refrigerator having a defrostable evaporator within a food storage compartment, a drain system for disposing of the defrost water dripping from the evaporator, said drain system comprising:

a drain tube positioned below said evaporator for receiving said defrost water, said drain tube including a drain trap portion for collecting said defrost water thereby blocking air flow through said drain tube; and a vent disposed on said drain tube upstream of said drain trap portion, said vent having a valve for allowing air flow into said food storage compartment while preventing air flow out of said food storage compartment.

2. The refrigerator drain system according to claim 1, further comprising:

a drip tray disposed within said food storage compartment below said evaporator, said drip tray being disposed above said drain tube and having a drain hole for supplying said defrost water to said drain tube.

3. The refrigerator drain system according to claim 1, further wherein:

said valve comprises a flapper pivotably mounted for blocking said vent, said flapper being configured for allowing air flow into said drain tube and for preventing air flow out of said drain tube.

4. A refrigerator having a defrostable evaporator within a food storage compartment, a drain system for disposing of the defrost water dripping from the evaporator, said drain system comprising:

a drain tube positioned below said evaporator for receiving said defrost water, said drain tube including a drain trap portion for collecting said defrost water thereby blocking air flow through said drain tube;

a vent extension portion extending from said drain tube upstream of said drain trap portion; and a flapper pivotably mounted within said vent extension portion, said flapper and said vent extension portion being configured for allowing air flow into said drain tube and for preventing air flow out of said drain tube.

5. The refrigerator drain system according to claim 1 wherein said evaporator pan is disposed in a condenser compartment below said food storage compartment and a partition wall separates said food storage compartment from said compressor compartment, said drain system further comprising:

a grommet disposed within said partition wall for forming a channel between said food storage compartment and said compressor compartment, said grommet having an upper end oriented toward said food storage compartment and a lower end oriented toward said compressor compartment; and a drip tray disposed within said food storage compartment below said evaporator, said drip tray being disposed above said first end of said drain tube and having a drain hole for supplying said defrost water to said upper end of said grommet, said drain tube being inserted into said lower end of said grommet for receiving said defrost water from said drip tray.

6. The refrigerator drain system according to claim 5 wherein said drain tube includes an annular raised portion disposed below said first end for limiting the insertion of said drain tube into said grommet.

7. A refrigerator having a defrostable evaporator within a food storage compartment, a drain system for disposing of the defrost water dripping from the evaporator, said drain system comprising:

a drain tube positioned below said evaporator for receiving said defrost water, said drain tube including:

a drain trap portion for collecting said defrost water thereby blocking air flow through said drain tube, and a vent disposed on said drain tube upstream of said drain trap portion, said vent having a valve for allowing air flow into said drain tube for equalizing the air pressure in said food storage compartment with the ambient air pressure but preventing air flow out of said drain tube; and an evaporator pan mounted below said food storage compartment for receiving said defrost water from said drain tube.

8. The refrigerator drain system according to claim 7, further comprising:

a drip tray disposed within said food storage compartment below said evaporator, said drip tray being disposed above said drain tube and having a drain hole for supplying said defrost water to said drain tube.

9. The refrigerator drain system according to claim 7, said vent further comprising:

a vent extension portion extending from said drain tube; and a flapper pivotably mounted within said vent extension portion, said flapper and said vent extension portion being configured for allowing air flow into said drain tube and for preventing air flow out of said drain tube.

* * * * *